US006719400B2

(12) United States Patent
Inui et al.

(10) Patent No.: US 6,719,400 B2
(45) Date of Patent: Apr. 13, 2004

(54) RECOVERY PROCESSING METHOD AND UNIT OF INK JET PRINTING APPARATUS

(75) Inventors: Toshiharu Inui, Kanagawa (JP); Shinji Takagi, Kanagawa (JP); Kentaro Yano, Kanagawa (JP); Tetsuhito Ikeda, Tokyo (JP); Masao Kato, Tochigi (JP); Katsuhiko Takahashi, Kanagawa (JP); Kenichi Saito, Kanagawa (JP); Tomonori Sato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/845,285

(22) Filed: May 1, 2001

(65) Prior Publication Data

US 2002/0018092 A1 Feb. 14, 2002

(30) Foreign Application Priority Data

May 2, 2000 (JP) ..... 2000-133892

(51) Int. Cl.[7] ..... B41J 2/165

(52) U.S. Cl. ..... 347/23; 347/19; 347/29; 347/30; 347/33; 347/35

(58) Field of Search ..... 347/23, 19, 24, 347/29, 30, 35, 14, 75–78, 33; 358/296, 502

(56) References Cited

U.S. PATENT DOCUMENTS

| | | | | | |
|---|---|---|---|---|---|
| 4,313,124 | A | | 1/1982 | Hara | 347/7 |
| 4,345,262 | A | | 8/1982 | Shirato et al. | 347/10 |
| 4,459,600 | A | | 7/1984 | Sato et al. | 347/47 |
| 4,463,359 | A | | 7/1984 | Ayata et al. | 347/56 |
| 4,558,333 | A | | 12/1985 | Sugitani et al. | 347/65 |
| 4,608,577 | A | | 8/1986 | Hori | 347/66 |
| 4,723,129 | A | | 2/1988 | Endo et al. | 347/56 |
| 4,740,796 | A | | 4/1988 | Endo et al. | 347/56 |
| 4,893,138 | A | * | 1/1990 | Terasawa et al. | 347/30 |
| 5,805,180 | A | * | 9/1998 | Ebisawa et al. | 347/23 |
| 6,109,724 | A | | 8/2000 | Takahashi et al. | 347/23 |
| 6,123,404 | A | * | 9/2000 | Tanaka et al. | 347/5 |
| 6,227,646 | B1 | | 5/2001 | Yano et al. | 347/23 |
| 6,293,645 | B1 | * | 9/2001 | Kim | 347/19 |
| 6,565,185 | B1 | * | 5/2003 | Endo | 347/23 |

FOREIGN PATENT DOCUMENTS

| | | | |
|---|---|---|---|
| JP | 54-56847 | | 5/1979 |
| JP | 59-123670 | | 7/1984 |
| JP | 59-138461 | | 8/1984 |
| JP | 60-71260 | | 4/1985 |
| JP | 361035959 | A * | 2/1986 |
| JP | 61-123545 | | 6/1986 |
| JP | 402241749 | A * | 9/1990 |
| JP | 4-269549 | | 9/1992 |
| JP | 6-122206 | | 5/1994 |
| JP | 11-179884 | | 7/1999 |
| JP | 11-179933 | | 7/1999 |

OTHER PUBLICATIONS

U.S. application No. 09/426,880, filed Oct. 26, 1999, patented on May 7, 2002, No. 63,382,765.

U.S. application No. 09/511,360, filed Feb. 23, 2000, pending.

Office Action in JP 2000–133892, dated Jul. 18, 2003.

* cited by examiner

*Primary Examiner*—Shih-Wen Hsieh

(74) *Attorney, Agent, or Firm*—Fitzpatrick, Cella, Harper & Scinto

(57) ABSTRACT

In the present invention, the minimum necessary consumption of ink can recover the channel miss state of the plurality of nozzles. The present invention provides a recovery processing method of an ink jet printing apparatus for forming images using a print head having a plurality of nozzles for ejecting ink droplets. The method comprises a first step for detecting channel miss state of said plurality of nozzles, and a second step for executing at least one of different recovery processes depending on the channel miss states of said plurality of nozzles detected in the first step.

11 Claims, 15 Drawing Sheets

RECOVERY PROCESSING METHOD AND UNIT OF INK JET PRINTING APPARATUS

This application is based on Patent Application No. 2000-133892 filed May 2, 2000 in Japan, the content of which is incorporated hereinto by reference.

BACKGROUND OF THE INVENTION

1. Field of the Invention

The present invention relates to a recovery processing method and unit of an ink jet printing apparatus, and more specifically, to a recovery processing method and unit for detecting whether or not each nozzle of an ink jet print head is in a non-ejection state or a channel miss state and executing a recovery processing of the print head.

2. Description of the Related Art

A rapidly increasing number of ink jet printing apparatuses are based on a method for printing images by operating heaters provided in ink ejecting nozzles filled with ink to rapidly generate bubbles in the nozzles so that the pressure of the bubbles causes the ink to be injected from the tips of the nozzles so as to land on an opposite printing medium. With the printing apparatus based on this method, as time goes by, remaining bubbles after ejection accumulate within the nozzles and gasses dissolved in the ink becomes bubbles which generate within the print head, thereby hindering the ink from being ejected from the nozzles, resulting in inappropriate printing.

It is also known that the ink remaining in the nozzles is fixed to the interior of the nozzles over time to prevent the ink ejection during image printing.

To solve these known problems, the ink jet printing apparatus of this kind performs a recovery operation by forcibly sucking the ink from the nozzles to correct the inappropriate ink ejection.

In the recovery operation, a suction and recovery operation is performed with predetermined timing, such as at power-on, or whether or not suction and recovery is to be carried out can be determined based on an elapsed time which is measured since the preceding recovery operation using a timer.

Since, however, the suction operation involves the discharge of a relatively large amount of ink, the number of suction operations must be minimized in order to restrain useless ink consumption. Additionally, execution of the suction and recovery operation does not always correct the inappropriate ink ejection successfully.

Thus, several detection systems for directly detecting ink droplets ejected from the nozzles have been proposed. Japanese Patent Application Laid-open No. 61-123545 (1986) describes the technique of detecting an output signal obtained when the ink droplets ejected from the nozzles impact on a channel miss detector after flying for a specified period of time, thereby determining whether or not a channel miss is occurring. If a channel miss is occurring, this channel miss state, which may be caused by clog or the like, is eliminated by simultaneously purging (sucking) all the ink channels in a print head.

As in the prior art, however, the ink is uselessly consumed if the recovery processing executed after the detection of the nozzle channel miss comprises only suction. As a result, running costs increase and it becomes necessary to increase the volume of a waste ink absorber for retaining sucked ink in the main body of a printer or the like. Consequently, the size and costs of the apparatus must be increased.

SUMMARY OF THE INVENTION

The present invention is provided to solve the above problems. It is an object of the present invention to provide a recovery processing method and unit of an ink jet printing apparatus which can detect the channel miss state of the nozzles of the ink jet print head and which can recover, if any nozzle is in the channel miss state, a normal state of this nozzle while minimizing the amount of useless ink.

According to one aspect of the present invention, a recovery processing method of an ink jet printing apparatus for forming images using a print head having a plurality of nozzles for ejecting ink droplets comprises a first step for detecting channel miss states of the plurality of nozzles and a second step for executing at least one of different recovery processes depending on the channel miss states of the plurality of nozzles detected in the first step.

In the first step, the number of nozzles in the channel miss state among the plurality of nozzles may be determined and in the second step, one of the different recovery processes may be executed depending on the result of this determination. In the second step, the recovery process corresponding to the states detected in the first step may be selected from at least two of those recovery processes in a variety of preliminary ejection modes and those recovery processes in a variety of suction modes. Furthermore, the recovery process by the preliminary ejection mode with low ink consumption may be executed when the number of channel miss nozzles is less. Also, the recovery process in the suction mode with recovery performance higher than that in the preliminary mode but with high ink consumption may be executed when the number of channel miss nozzles is more.

According to another aspect of the present invention, a recovery processing unit of an ink jet printing apparatus for forming images using a print head having a plurality of nozzles for ejecting ink droplets comprises a channel miss detecting means for detecting the channel miss state of the plurality of nozzles and a recovery control means for selecting at least one of a plurality of different recovery processes depending on the channel miss states of the plurality of nozzles detected by the channel miss detecting means and for executing the selected recovery process.

The above and other objects, features and advantages of the present invention will become more apparent from the following description of embodiments thereof taken in conjunction with the accompanying drawings.

DETAILED DESCRIPTION OF THE PREFERRED EMBODIMENT

Embodiments of the present invention will be described below with reference to the drawings.

(Configuration for Detecting the Channel Miss State)

First, a method for providing a channel miss detecting electrode on a silicon substrate constituting a print head will be explained as an ink channel miss detecting method applicable to the present invention.

Figure 1:
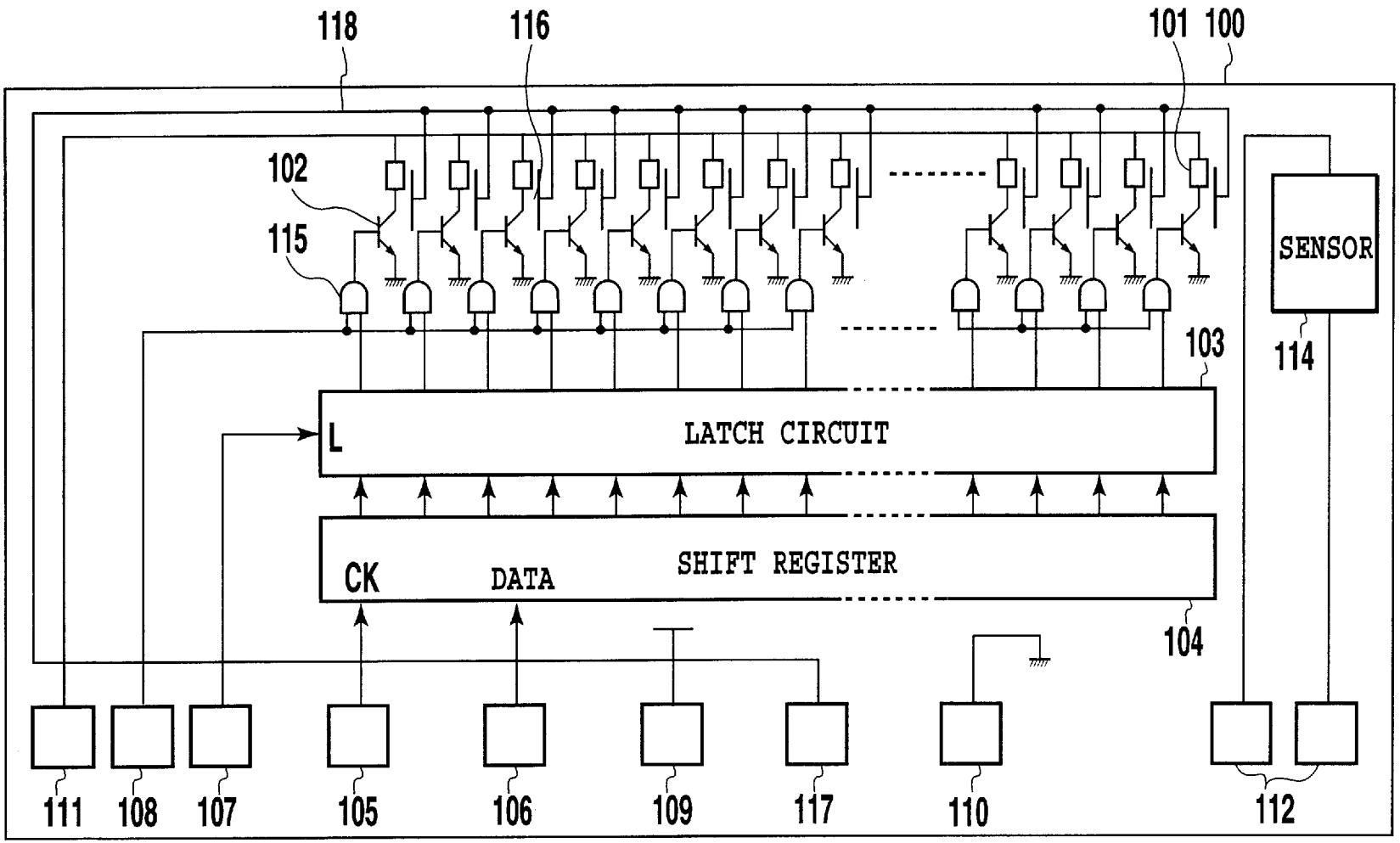
FIG. 1 is a top view useful in explaining a general configuration of an ink jet print head substrate.

FIG. 1 is a view showing a basic configuration of a print head substrate.

In this figure, an element substrate 100 as a print head substrate has heating elements 101 arranged therein and acting as printing elements for supplying thermal energy to ink in order to eject it. Further, each of power transistors (drivers) 102 are provided corresponding to each of a plurality of parallel-arranged heating elements (printing elements) to drive it. Moreover, a shift register 104, a latch circuit 103, and a plurality of AND gates 115 are formed on the element substrate 100. The shift register 104 serially receives the inputs of image data from an exterior via a terminal 106 and the inputs of serial clocks synchronizing with the image data to retain one line of image data. The latch circuit 103 synchronizes with latching clocks (latch signals) input via a terminal 107 to latch one line of image data output from the shift register 104 in parallel and transfers the image data to the power transistors 102 in parallel. The plurality of AND gates 115 are each provided corresponding to each of the power transistors 102 to apply an output signal from the latch circuit 103 to the power transistor 102 in accordance with an external enable signal. Reference numeral 108 denotes a drive pulse (heat pulse) signal input terminal for controlling, from the exterior of the print head portion, the on time of the power transistor 102 acting as a drive element, that is, the period of time when current is allowed to flow through the heating element 101 to drive it. Reference numeral 109 denotes a terminal for inputting a driving power supply (5 V) for logic circuits such as the latch circuit 103 and the shift register 104. Furthermore, a ground terminal 110, a terminal 112 for driving or monitoring a sensor 114, and other terminals are provided. The terminals 105 to 112 thus formed on the substrate 100 are input terminals for receiving the inputs of image data, various signals, or the like from the exterior.

Further, a sensor 114, such as a temperature sensor for measuring the temperature of the element substrate 100 or a resistance sensor for measuring the resistance value for each heating element 101, is formed on the element substrate 100.

Figure 6:
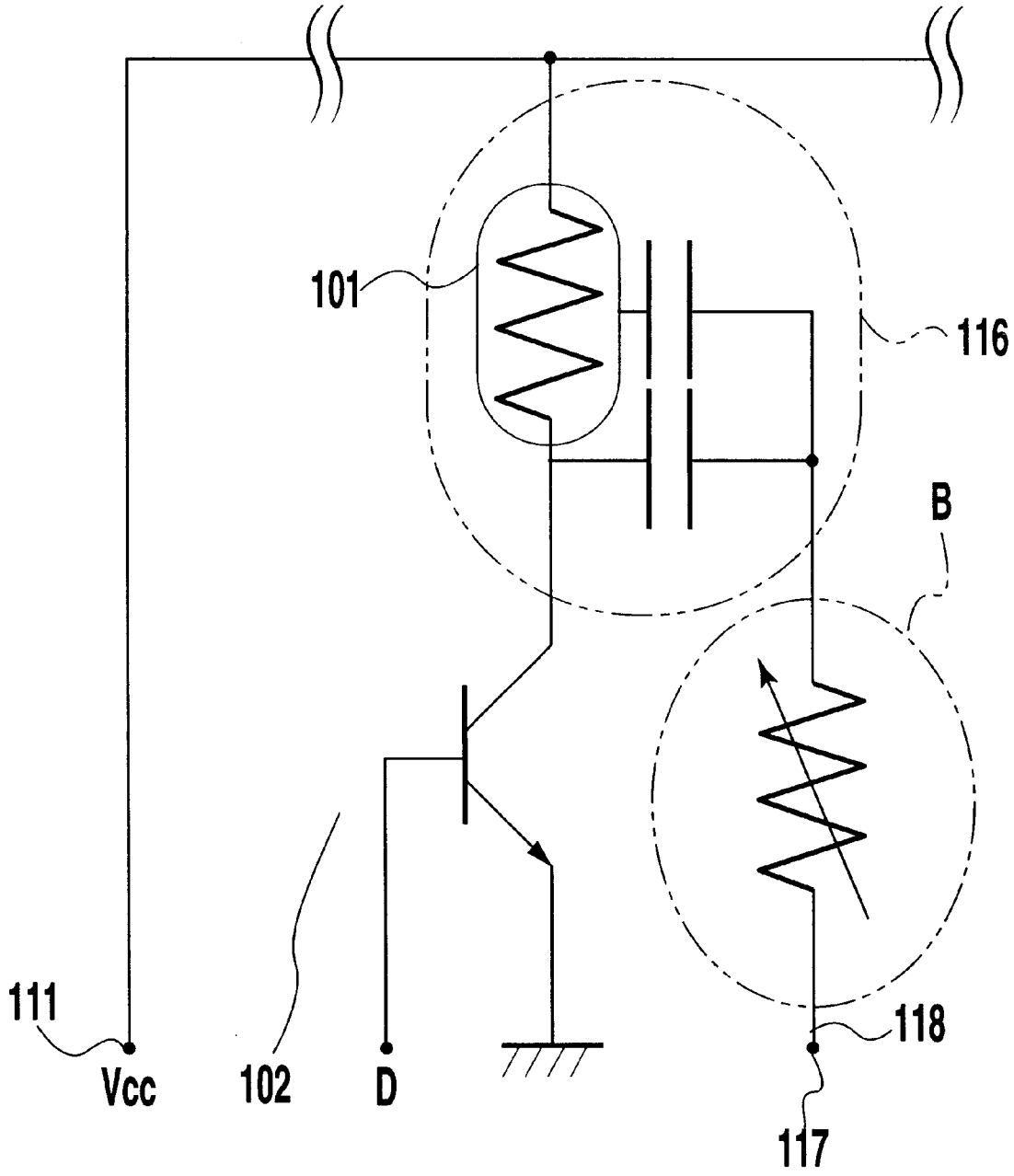
FIG. 6 is an equivalent circuit diagram corresponding to a configuration of a periphery of an ink detecting electrode on the ink jet printing head substrate.

Moreover, the element substrate 100 has a detection electrode 118 for detecting channel miss nozzles. The detection electrode 118 is AC-coupled to a drive circuit for the heater 101 via a protective film 405, a cavitation resistant film 205, and the ink in nozzles (see FIGS. 4 and 6), as described later. Reference numeral 116 in FIG. 1 denotes the AC coupled portion, which constitutes an equivalent circuit as a capacitor as shown in FIG. 6. The portion in FIG. 6 which is enclosed by a chain double dashed line B is a portion in a nozzle where its electric resistance varies depending on the amount of ink present as described later. Reference D in FIG. 6 represents a drive signal from the AND gate 115.

In such a configuration, image data input as a serial signal are converted by the shift register 104 into a parallel signal, and are retained in the latch circuit 103 in synchronism with the latch clock. In this state, a pulse signal (an enable signal for the AND gates 115) for driving the heating elements 101 is input to turn on the relevant power transistors 102 in accordance with the image data, so that current flows through the corresponding heating elements 101 to generate thermal energy. On the element substrate 100, a roof to form channels (also called the "nozzles") for ink ejection and a shared liquid chamber in communication with the channels is engaged. This configuration allows the ink contained in an ink tank (also called an "ink containing section") to be supplied to each nozzle via the shared liquid chamber for a stable ink supply. As described previously, thermal energy generated by driving the heating elements heats the ink in the channels (nozzles) to eject it through ejection ports at the tips of the nozzles as droplets.

Figure 2:
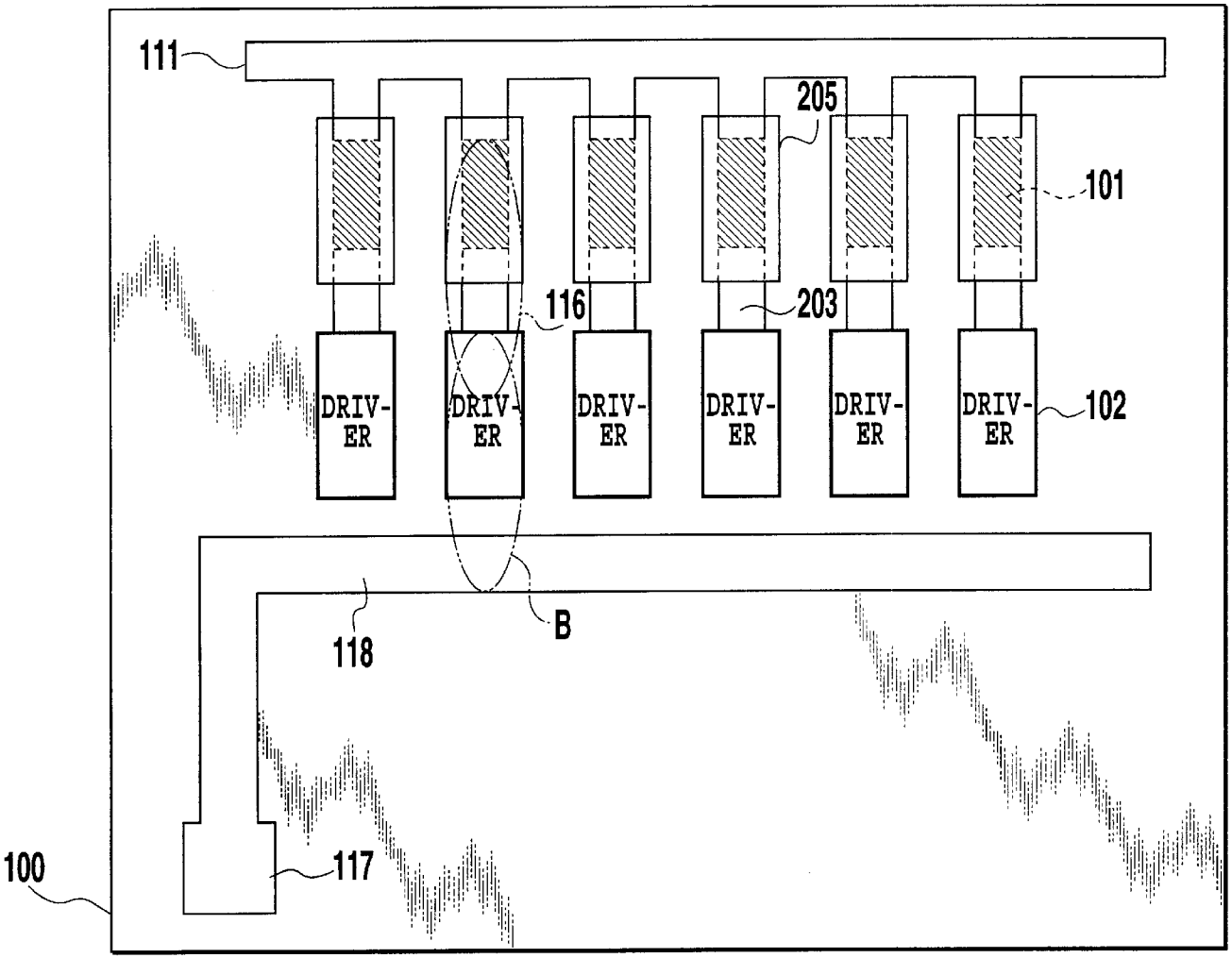
FIG. 2 is a top view showing a general configuration of an integral part of the ink jet printing head substrate shown in FIG. 1.
Figure 3:
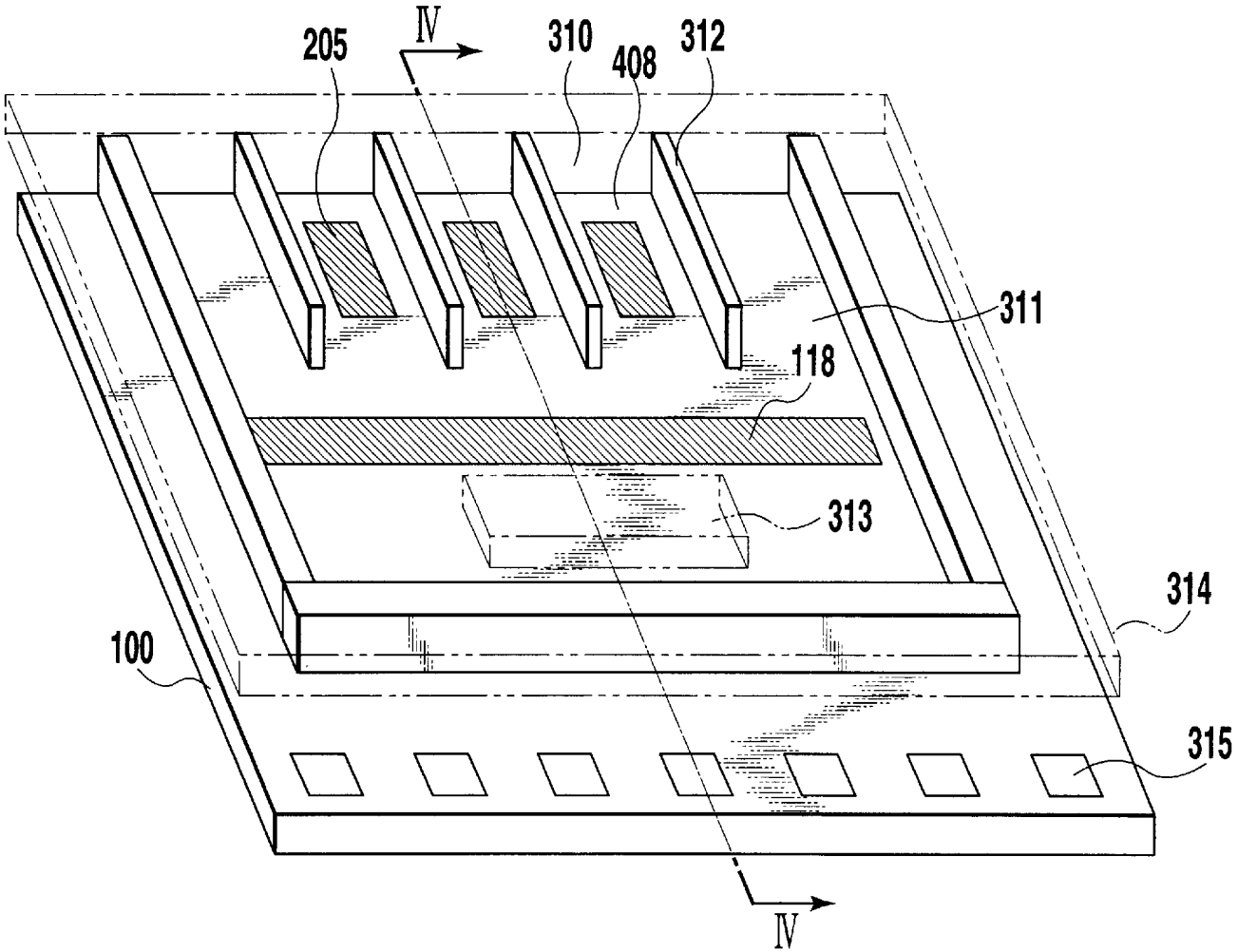
FIG. 3 is a schematic perspective view showing that nozzles are configured by joining a roof to the ink jet printing head substrate in FIG. 1.
Figure 4:
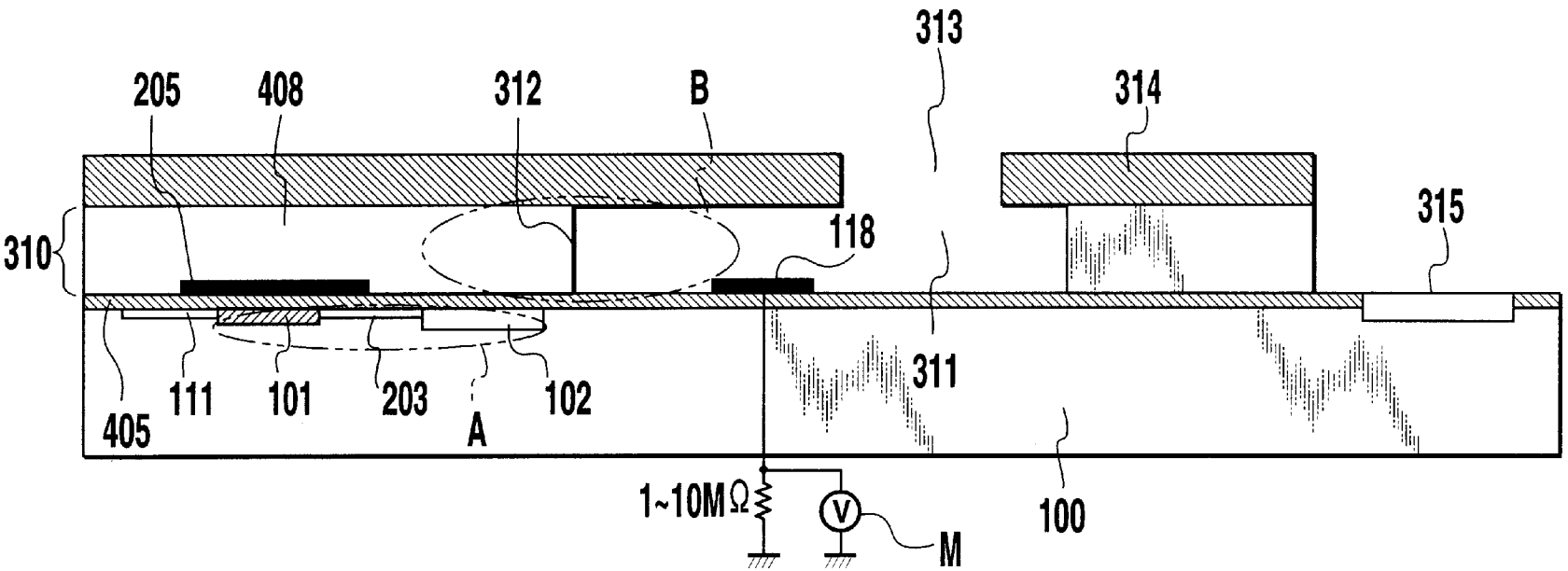
FIG. 4 is a sectional view of a peripheral portion of the nozzle, taken along line IV—IV in FIG. 3.
Figure 5:
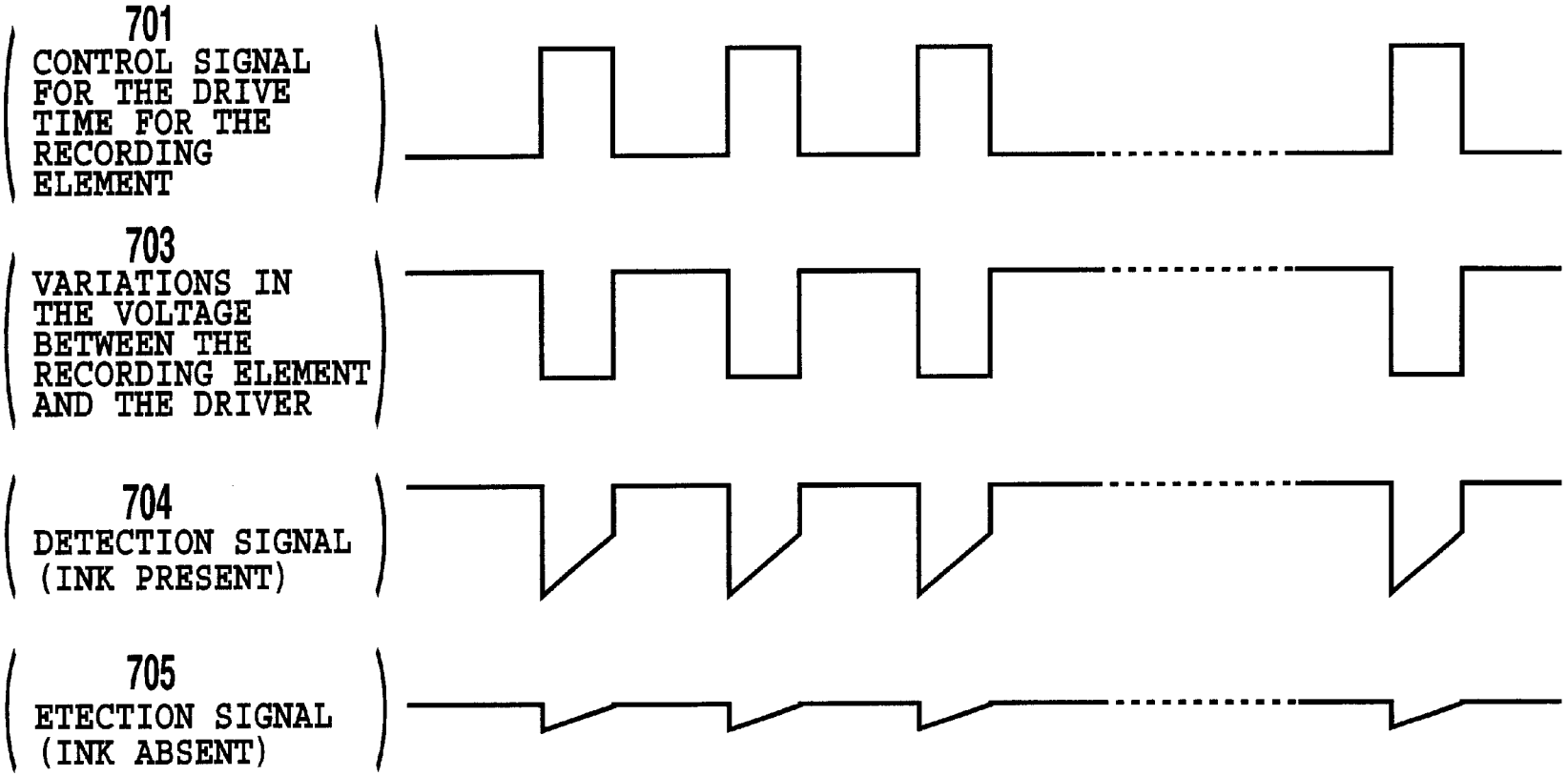
FIG. 5 is a time chart useful in explaining the operation of detecting the presence or absence of ink in the nozzle.

FIG. 2 is a top view showing a general configuration of the ink jet print head substrate in FIG. 1 and showing a general layout of the elements, electrodes, terminals, and the like provided on the substrate. FIG. 3 is a schematic perspective view showing that a roof for constituting the ejection ports and the nozzles is engaged to the ink jet print head substrate in FIGS. 1 and 2. FIG. 4 is a sectional view showing a configuration of the substrate and the nozzles wherein the roof is engaged to the ink jet print head substrate. This figure is a sectional view taken along line IV—IV in FIG. 3. FIG. 5 is a chart showing the state of the voltage at each portion on the ink jet print head substrate upon driving a heating element as a printing element.

The reference numeral 101 shown in FIG. 2 denotes the heating element (hereafter referred to as the "heater") acting as a printing element and being driven by the driver 102 acting as a drive element. Reference numeral 203 denotes wiring connecting one end of the heater 101 to the driver 102. Reference numeral 111 denotes wiring for supplying a power supply voltage to the other end of the heater 101. An electrically insulated protective film 405 (protective layer) is formed on the heater 101 as shown in FIG. 4 and a cavitation resistant film 205 is disposed above the heater 101 via the protective film 405. In FIG. 2, the illustration of the protective films 405 is omitted in order to explain the arrangement of the heaters 101, the drivers 102, and the like. The ink jet print head explained in the present embodiment employs what is called a bubble jet method in which thermal energy generated when the heaters 101 are driven is used to generate bubbles in the ink in the nozzles so that the growing pressure of the bubbles causes the ink to be ejected through the ejection ports 310 (see FIGS. 3 and 4). The above-mentioned cavitation resistant films 205 are provided so that the impact of the contraction of the bubbles generated when the ink is ejected is restrained from being transmitted to the heaters 101 or the protective films 405. The cavitation resistant films 205 are formed of high-melting-point metal such as tantalum. Reference numeral 118 denotes an electrode wiring provided for detecting the ink, and reference numeral 117 denotes an external terminal provided at an end of the electrode wiring 118 to electrically connect to an exterior of the substrate.

Characteristic configurations of this print head substrate comprise the arrangement of the separate cavitation resistant films 205 for the corresponding heaters (printing elements) 101 and the layout of the detection electrode 118 away from the driver 102 and away from the wiring 203 between the heater 101 and the driver 102, as shown in FIG. 2. The detection electrode 118 can be formed as a wiring pattern.

How to detect the presence or absence of ink in the nozzles in the configuration of the ink jet print head substrate shown in FIG. 2 will be explained below in detail with reference to FIGS. 3 and 4.

As described above, FIG. 3 is schematic perspective view showing that the roof 314 is engaged to the ink jet print head substrate 100. The roof 314 and the substrate 100 are engaged to each other to constitute nozzle portions 408 (see FIG. 4) and a shared liquid chamber 311. In FIG. 3, the configuration of a wall member as the roof 314 is represented by a dotted line in order to describe the configuration of the nozzle portions 408 and the shared liquid chamber 311. As shown in FIG. 2, reference numeral 205 denotes the cavitation resistant film. Further, since the heaters 101 as printing elements are located below the cavitation resistant films 205 and the insulated protective films 405 are formed over the heaters 101, as described previously, the heaters 101 are not illustrated in FIG. 3. This applies to the drivers 102 for driving the heaters 101 thus the drivers are not illustrated in FIG. 3.

An important feature of the present invention is the relationship between the portion of the heater 101 (not shown in FIG. 3) including the separate cavitation resistant film 205 for each nozzle, the drivers 102 (not shown in FIG. 3), the nozzle portion 408 formed of a nozzle wall 312 and the detection electrode 118 for ink detection.

In FIG. 4, drive power supplied by a power supply section via the power supply wiring 111 is provided to the relevant heaters 101 in accordance with switching by the corresponding drivers 102 to generate thermal energy. This thermal energy causes bubbles to be generated in the nozzle to eject the ink through the ejection ports 310.

Before the relevant heater 101 is driven in accordance with switching by the corresponding driver 102, that is, when the driver 102 is off, the potential at the heater 101, the potential of the wiring 203 between the heater 101 and the driver 102, and the potential of part of the wiring on the driver 102 (a portion of the wiring which is closer to the heater 101 from a portion acting as a switch in the driver 102) are each the same as the potential of the heater power supply wiring 111. Further, since the ink (the ink generally contains ions and is thus conductive) is electrically floating, that is, the ink has a high DC impedance with respect to the ground, the potential at the cavitation resistant film 205 on the protective film 405 is electrically floating, that is, the cavitation resistant film 205 has a high DC impedance with respect to the ground, as in the ink. Likewise, the potential at the detection electrode 118 is basically electrically floating and is substantially determined by the input impedance of a device connected to detect the potential of the detection electrode 118. In this example, to detect the potential at the detection electrode 118, a voltage monitor M and a 1-to 10-MΩ resistor are connected between the detection electrode 118 and the ground in parallel as shown in FIG. 4. Thus, before the heater 101 is driven, the detection potential is 0 V.

On the other hand, when the heater 101 is driven, that is, the driver 102 is switched on to connect the wiring 203 to the ground, current naturally flows through the heater 101. In this case, a portion of the heater 101 which is closer to the driver 102 becomes a lower potential. And the potential of the wiring 203 between the heater 101 and the driver 102 and the potential of the part of the wiring on the driver 102 rapidly decrease substantially down to the ground level. In FIG. 4, in the portion enclosed by the chain double dashed line A, the voltage falls rapidly when the heater 101 is driven. It has been found that when the voltage falls in the above manner, the protective film 405, which has acted as an insulated film under DC conditions, acts as a dielectric film for a capacitor to transmit variations in potential, in an AC manner, to the cavitation resistant film 205 provided on the heater 101 via the protective film 405 so as to extend to the driver 102, as well as to the ink located on the cavitation resistant film 205. Thus, when any ink is present in the nozzle portion 408 and in the shared liquid chamber portion 311, variations in the potential of the ink are transmitted to the detection electrode 118. Further, when no ink is present in the nozzle portion 408 and/or the shared liquid chamber 311, variations in potential are transmitted to the cavitation resistant film 205, but the electric resistance in the nozzle portion 408 and/or the shared liquid chamber portion 311 between the cavitation resistant film 205 and the detection electrode 118 increases significantly, thus the variations in potential transmitted to the detection electrode 118 substantially are reduced or eliminated. Thus, the variation of the potential at the detection electrode 118 depends on the amount of ink present in the nozzle portion 408 and the shared liquid chamber portion 311, and in an extreme case, on the presence of ink, so that the amount of ink present between the driven heater 101 and the detection electrode 118, or the presence of ink can be detected.

In FIGS. 2 and 4, in the portion enclosed by the chain double dashed line B, the electric resistance varies depending on the amount of ink present, that is, this portion significantly affects the variation of the potential at the detection electrode 118. In addition, the portion enclosed by the chain double dashed line 116 in FIG. 2 corresponds to the AC coupling portion in FIGS. 1 and 6.

FIG. 5 is a timing chart useful in explaining an ink detecting operation utilizing the above detection principle. Reference numeral 701 denotes an enable signal for determining timing with which and the amount of time for which the heater 101 is driven. The heaters 101 are sequentially and individually driven synchronously with the enable signal based on a driver controlling signal (not shown). Reference numeral 703 denotes the potential of the wiring 203 between the heater 101 and the driver 102. Like the potential 703, the potential at a portion of the heater 101 which is closer to the driver 102 and the potential of the part of the wiring on the driver 102 (the portion of the wiring which is closer to the heater 101 from the portion acting as a switch in the driver 102) vary. That area including these portions in which the voltage varies is called a "voltage varying area". On the heater 101, the amplitude of the variation of the voltage varies depending on a position thereon. The closer the position is to the driver 102, the larger the amplitudeis.

Further, the surface potential of the insulated protective film 405 can be assumed to be almost identical to the potential of the underlying voltage varying area. Reference numerals 704 and 705 denote ink detection signals obtained based on variations in the potential at the detection electrode 118. The detection signal 704 is obtained when any ink is present in the portion B in FIG. 4, and the detection signal 705 is obtained when no ink is present in the portion B. When any ink is present in the portion B, the electric resistance of the portion B is so low that the detection electrode 118 detects a large variation in potential, that is, in the detection signal 704. On the other hand, without any ink in the portion B, the electric resistance of the portion B is so high that the detection electrode 118 detects a small variation in potential, that is, in the detection signal 704. In this manner, the detection signal detected by the detection electrode 118 varies depending on the presence or absence of ink in the portion B. Of course, the detection signal detected by the detection electrode 118 varies depending on the amount of ink present in the portion B.

The presence or absence of ink or the amount of ink present can be detected for each driving nozzle by time-dividing these detection signals from the detection electrode 118 synchronously with the drive timing for the heater 101. The detection signal 704 in FIG. 5 is obtained if all the drive nozzles contain ink, and the detection signal 705 in FIG. 5 is obtained if no drive nozzle contains ink. That is, if any driving nozzle contains no ink, only the detection signal corresponding to that driving nozzle appears as the detection signal 705 with smaller variations, while the detection signals corresponding to the other driving nozzles appear as the detection signal 704 with larger variations.

Since the separate cavitation resistant films 205 are provided for the corresponding heaters 101, variations in the potential at each nozzle dependent on the presence or absence of ink can be reliably detected without being adversely affected by the adjacent nozzle. Further, the separate cavitation resistant films 205 are thus provided for the corresponding heaters 101, and the detection electrode 118 is shared by all the nozzles to sequentially drive the nozzles in a time division manner, so that the presence or absence of ink in each of a plurality of arranged nozzles can be detected based on the detection signals from the one detection electrode 118.

Further, since the heater 101 itself can be used as a source of the ink detection signal, the presence or absence of ink in each nozzle can be detected by using a logic circuit as conventionally provided in a print head so as to constitute a shift register or the like. The presence or absence of ink can be detected using a very simple configuration without any need to complicate the structure.

(Another Configuration for Detecting Channel Miss)

Figure 7:
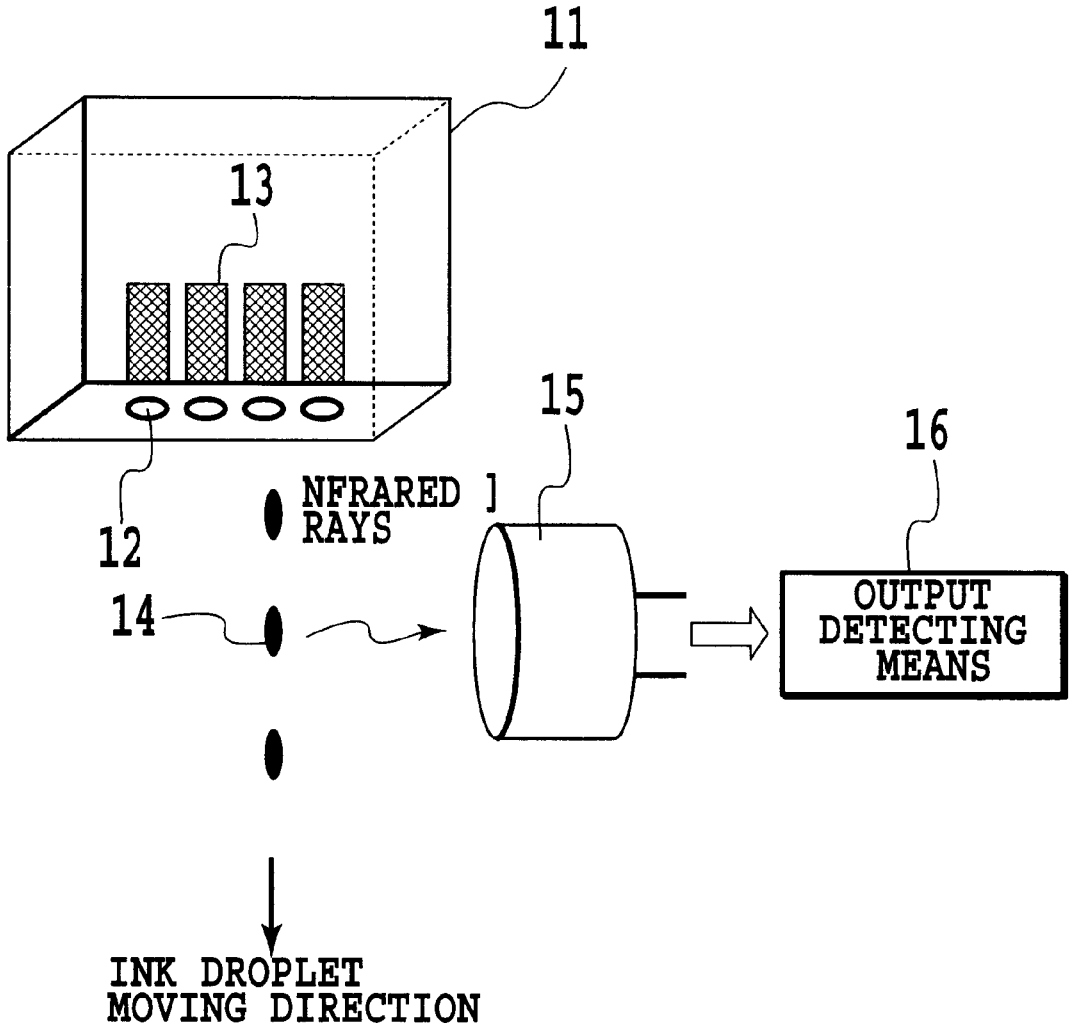
FIG. 7 is a view showing another conceptual configuration for ink detection.

FIG. 7 is a schematic view useful in explaining another configuration for detecting the channel miss that is applicable to the present invention.

In FIG. 7, reference numeral 11 denotes a print head of the ink jet printing apparatus. The print head 11 is filled with ink and has nozzles 12 formed therein for ejecting the ink. A heater 13 which is driven by a liquid ejecting means (not shown) for feeding ink with a predetermined timing pattern is installed in each nozzle. Electricity is conducted through the heaters 13 to generate heat to thereby generate bubbles in the ink in the nozzles so that the pressure of the bubbles causes ink droplets to be ejected toward the openings of the nozzles. Reference numeral 14 denotes ejected ink droplets. A channel miss detecting means 15 is installed in the middle of a passage of the ink droplets at a location where it does not come into contact with any ink droplets, thereby detecting the presence or absence of the passage of the ink droplets without coming into contact with any ink droplets.

The ink droplets 14 are heated by the heater 13 on ejection, and of the radiation waves emitted from the ink droplets, an infrared wavelength band has a particularly high radiation intensity. Accordingly, an infrared sensor for detecting radiation of the infrared wavelength band is preferably used as a channel miss detecting means. A typical known infrared sensor is a pyroelectric infrared sensor using a pyroelectric element that changes its potential in response to the infrared wavelength band.

Since the output from the channel miss detecting means 15 varies each time the ejected ink droplets pass this means, the presence or absence of the passage of the ink droplets can be detected by the output detecting means 16 by detecting whether or not this output has varied.

(Entire Configuration)

Figure 8:
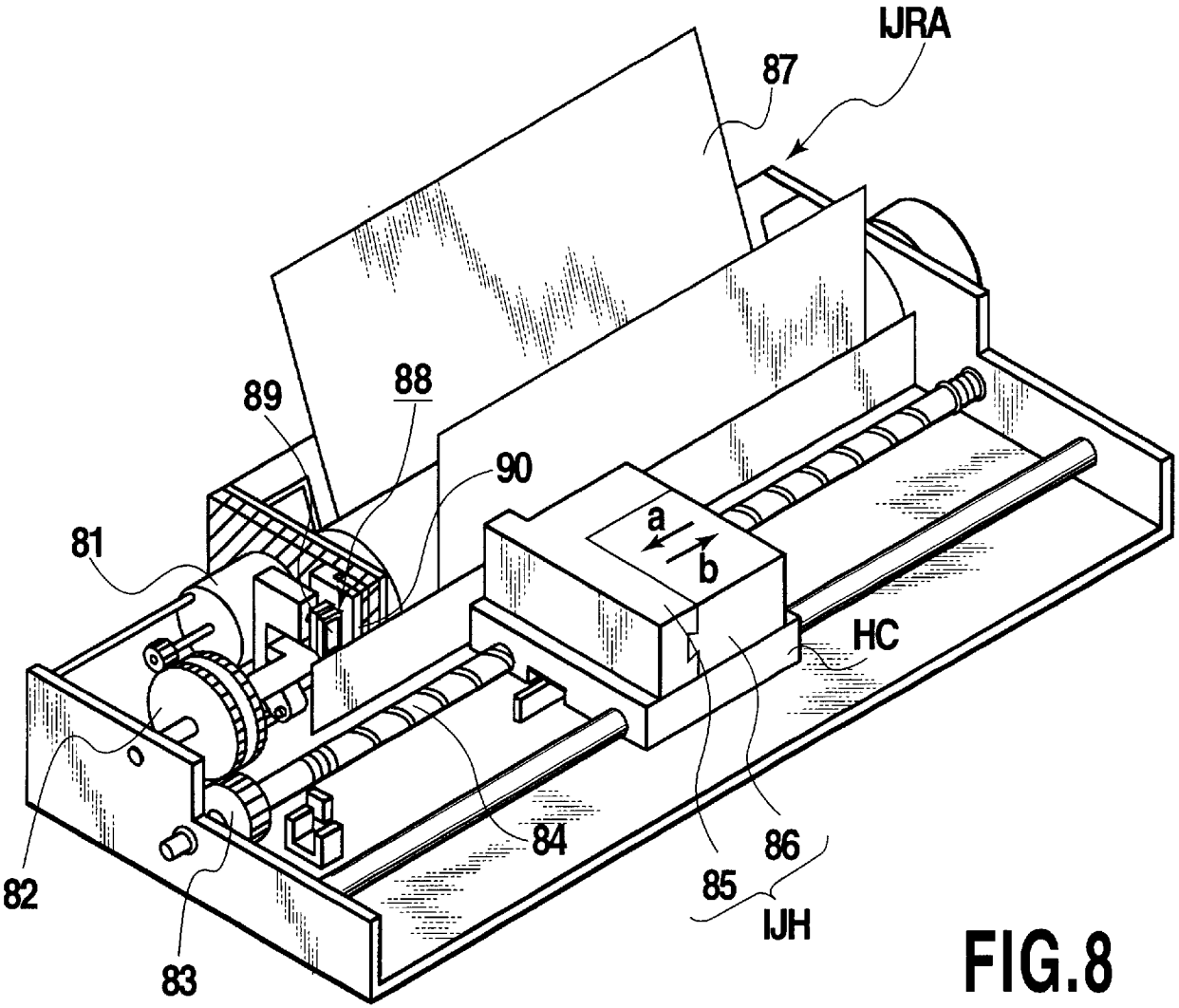
FIG. 8 is a perspective view showing a general configuration of an ink jet printing apparatus to which the present invention is applicable.

FIG. 8 is a schematic view of an ink jet printing apparatus IJRA to which the present invention is applicable.

In this figure, a lead screw 84 is rotated forward and reverse by means of forward and reverse rotation of a drive motor 81 via driving force transmitting gears 82 and 83. A carriage HC has a pin (not shown) that engages with a spiral groove in the lead screw 84 so as to be reciprocated in the directions of arrows a and b in the figure depending on the rotating direction of the lead screw 84. The carriage HC has a head cartridge IJH mounted thereon and comprising an ink jet print head 85 and an ink tank 86. The ink jet printing apparatus IJRA shown in FIG. 8 is generally called a "serial printer". The apparatus IJRA executes a printing operation all over a printing sheet 87 by repeating a main scan of the carriage HC along the directions of the arrows a and b and a subscan of the printing sheet 87 as a printing medium.

A suction recovery system unit 88 is provided at a left end of an area in which the carriage HC can be moved, so as to be opposite to each ink ejecting port in the print head 85 on the carriage HC. The suction recovery system unit 88 comprises a cap member 89 for capping a face of the print head 85, a wiper blade 90 for wiping the face of the print head 85, a pump (not shown) for sucking the ink from each nozzle through the cap via an ink channel, and the like. The suction recovery system unit 88 performs a suction recovery operation for maintaining an appropriate ink ejection state of the print head 85.

Further, a preliminary ejection ink receiver (not shown) is disposed near the cap member, for receiving the ink ejected during preliminary ejection, described later.

Figure 9:
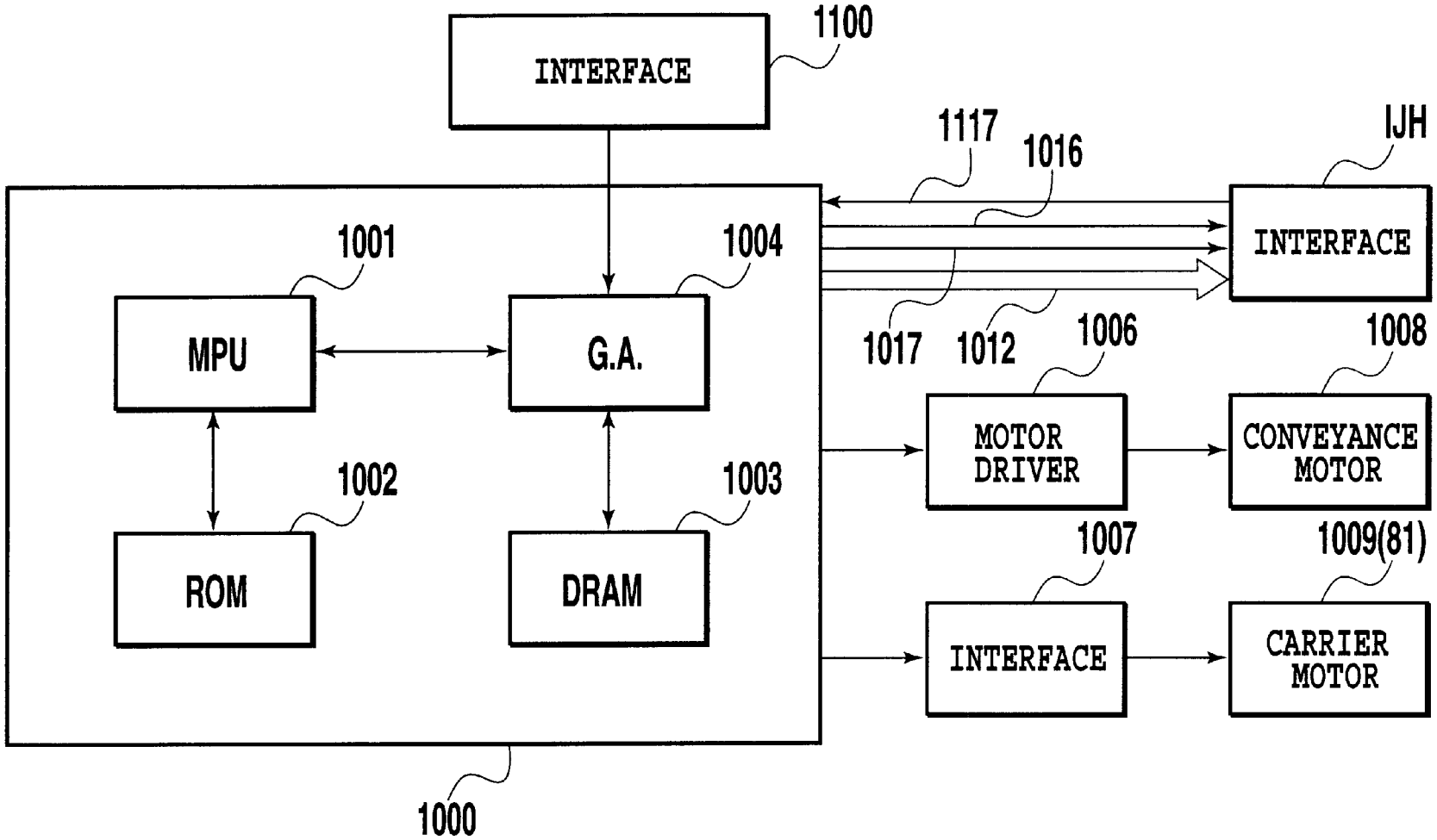
FIG. 9 is a block diagram showing a control system for the ink jet printing apparatus shown in FIG. 8.

FIG. 9 is a block diagram showing a configuration of an integral part of a control section for controlling printing executed by the printing apparatus shown in FIG. 8.

In FIG. 9, reference numeral 1000 denotes a control circuit and reference numeral 1100 denotes an interface for receiving the input of a printing signal and receiving data transferred from host equipment or the like externally connected to the printing apparatus IJRA. Reference numeral 1001 denotes an MPU, reference numeral 1002 denotes a program ROM in which control programs executed by the MPU 1001 are stored, and reference numeral 1003 denotes a dynamic RAM to which various data (the above printing signal and printing data supplied to the head) are saved. Reference numeral 1004 denotes a gate array for controlling the supply of the printing data to the head cartridge IJH and controlling the data transfer between the interface 1100 and the MPU 1001 and the RAM 1003. Reference numeral 1009 denotes a carrier motor for scanning the carriage HC (FIG. 8) with the head cartridge IJH mounted thereon, and reference numeral 1008 denotes a conveyance motor for conveying the printing sheet 87 as the printing medium. Reference numerals 1006 and 1007 denote motor drivers for the driving the conveyance motor 1008 and the carrier motor 1009, respectively.

Reference numeral 1117 denotes a signal line connected to the terminal 117 shown in FIGS. 1 and 2 and via which the head cartridge IJH is electrically connected to the detection electrode 118 of the ink jet print head substrate 100. When ink is detected, variations in voltage dependent on the amount of ink (the presence or absence of ink) are input from the terminal 117 to the control circuit 1000 of the apparatus main body via the terminal 117. Reference numeral 1012 denotes a signal line for outputting various signals including an enable signal for driving the heaters 101 acting as printing elements, a clock signal input to the logic circuit on the element substrate 100, and a latch signal. Further, reference numeral 1016 denotes a signal line for causing a power supply section (not shown) to supply drive power to the head cartridge IJH to drive the heaters 101 acting as printing elements. Reference numeral 1017 denotes a signal line for supplying an electric power to the logic circuit on the print head element substrate 100 mounted on the head cartridge IJH.

The control section configured as described above can detect the presence or absence of ink in the nozzle by driving the relevant heaters 101 with arbitrary timing, receiving the inputs of detection signals obtained by the detection electrode 118 on the element substrate 100 via the signal line 1117 and the terminal 117, and monitoring these signals. For such timing with which the presence or absence of ink is detected, the presence or absence of ink can be detected for each nozzle by sequentially driving the heaters for the corresponding nozzles when, for example, no printing operation is being performed on the printing medium. In general, in the ink jet printing apparatus, it is known that the preliminary ejection operation of preliminarily ejecting the ink, that is, the operation of carrying out only ejection without sucking the ink is performed in order to recover the ejection function of the ink jet print head. Thus, the timing for the preliminary ejection operation can be utilized to individually detect the state of each nozzle concerning the presence or absence of ink. Of course, the ink can be detected during the printing operation.

The signals obtained by the detection electrode 118 can be monitored by the MPU 1001 provided on the control circuit and acting as a control means. By associating the driven heaters 101 with variations in the potential at the detection electrode 118, the presence or absence of ink can be detected for each of the arranged nozzles. Therefore, it is possible to identify nozzles which contain no ink and thus cannot execute the ink ejection or nozzles which have the possibility of failing to eject the ink.

(Recovery Method)

Next, a recovery processing method for recovering the ejection function of channel miss nozzles will be described.

Figure 10A:
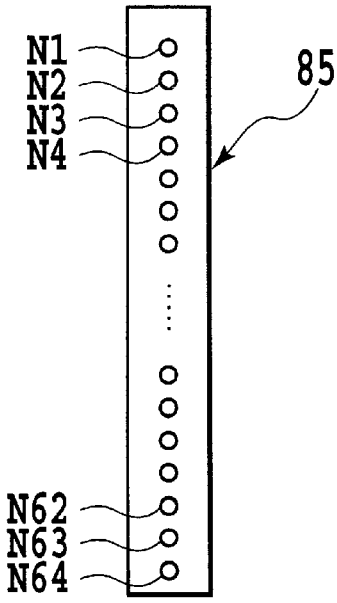
FIGS. 10A, 10B, and 10C are views useful in explaining the state where non-ejecting nozzles are detected.

FIG. 10A shows an example of a general configuration of the print head 85 mounted in the ink jet printing apparatus. The print head 85 includes 64 nozzles N1 to N64 each having a heater (not shown) for generating bubbles in the ink so that the pressure of the bubbles causes the ink to be ejected.

Figure 10B:
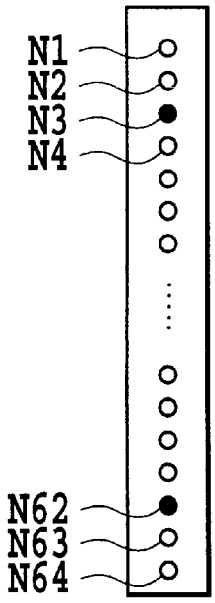
Figure 10C:
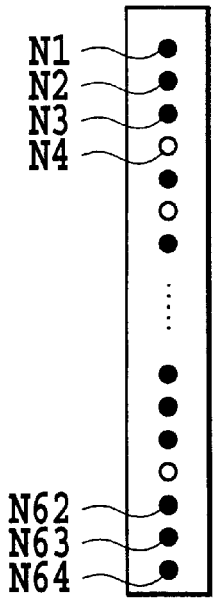

FIGS. 10B and 10C show the results of the detection, executed by the above channel miss detecting means, of the channel miss state for each nozzle in the print head shown in FIG. 10A. Those nozzles painted in black are in the channel miss state.

FIG. 10B shows that nozzles N3 and N62 of the array are in the channel miss state. In such a state, a large amount of ink is uselessly consumed when the ink is sucked for a recovery process. In this case, bubbles are likely to be present in the channel miss nozzles. When bubbles are present in a small number of nozzles as described above, the bubbles remaining in the head can be discharged by executing the preliminary ejection, that is, carrying out only ejection without sucking the ink.

The preliminary ejection for discharging the bubbles to the exterior of the print head is preferably carried out under conditions that cause turbulence in the ink in the nozzles and in the liquid chamber for supplying ink to the nozzles. Specifically, ejection from the odd-numbered nozzles and the even-numbered nozzles is alternately and repeatedly carried out in a predetermined number of times.

On the other hand, in FIG. 10C, since half or more of the nozzles are in the channel miss state, the ink in the nozzles and the liquid chamber is unlikely to flow due to the channel miss state despite the conditions that the preliminary ejection from the odd-numbered nozzles and the even-numbered nozzles is alternately and repeatedly carried out in a predetermined number of times, thus making it difficult to eject the bubbles. Consequently, in this case, a preferable recovery process is to carry out the suction instead of the preliminary ejection.

Further, if the channel miss is not caused by the bubbles but by, for example, the fixation of the ink to the interior of the nozzles, the suction is more effective than the preliminary ejection but the above-mentioned channel miss detecting means cannot identify the cause of the channel miss. Thus, in the state in FIG. 10B, the preliminary ejection is first executed and the ejecting state is then detected again so that the suction can be carried out if the normal state has not been recovered yet. Then, the occurrence of useless ink can be prevented compared to the unconditional suction.

(Example 1 of the Recovery Process)

Figure 11:
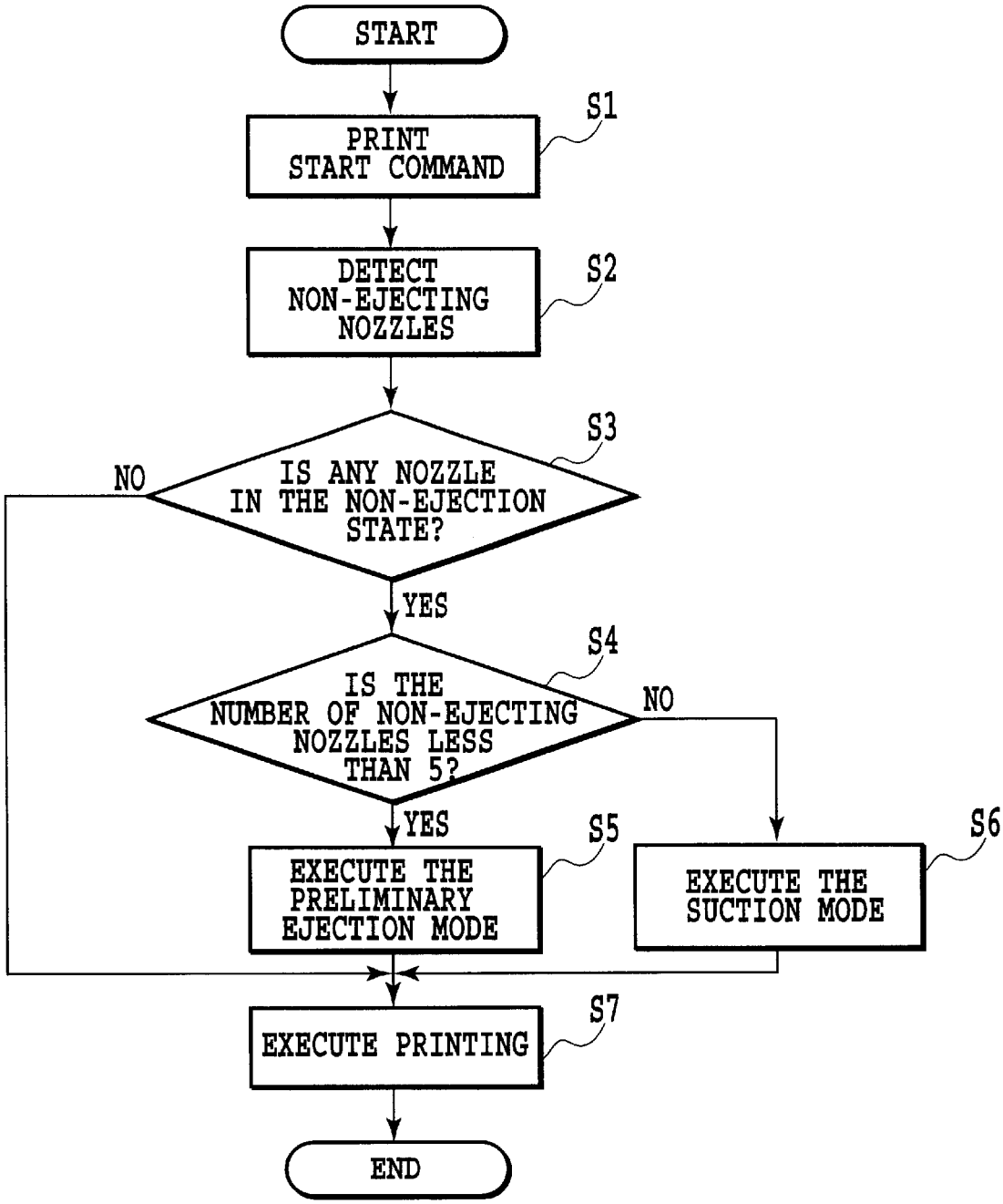
FIG. 11 is a flow chart showing a first embodiment for a recovery process executed by the ink jet printing apparatus according to the present invention.

FIG. 11 is a flow chart showing a first example of the recovery processing method for the ink jet printing apparatus. The operation of this method will be described below with reference to FIG. 11. This flow chart shows an operational procedure executed by the control circuit 1000 in FIG. 9.

When a print start command is first input (step S1), the above-mentioned channel miss detecting means detects channel miss nozzles (step S2). It is then determined based on the results of the detection whether or not any nozzle is in the channel miss (step S3). If no nozzle is in the channel miss, the procedure shifts to step S7 to perform a print operation.

On the other hand, if it is determined that any nozzles are in the channel miss, then the level of the channel miss is determined (step S4).

That is, when the number of channel miss nozzles is a predetermined number n (in this case, five) or less, a recovery operation in a preliminary ejection mode is executed (step S5). In contrast, when the number exceeds n, a recovery operation in a suction mode is executed (step S6).

After the recovery process in step S5 or S6 has been completed, the procedure proceeds to step S7 to execute the print operation.

Figure 12:
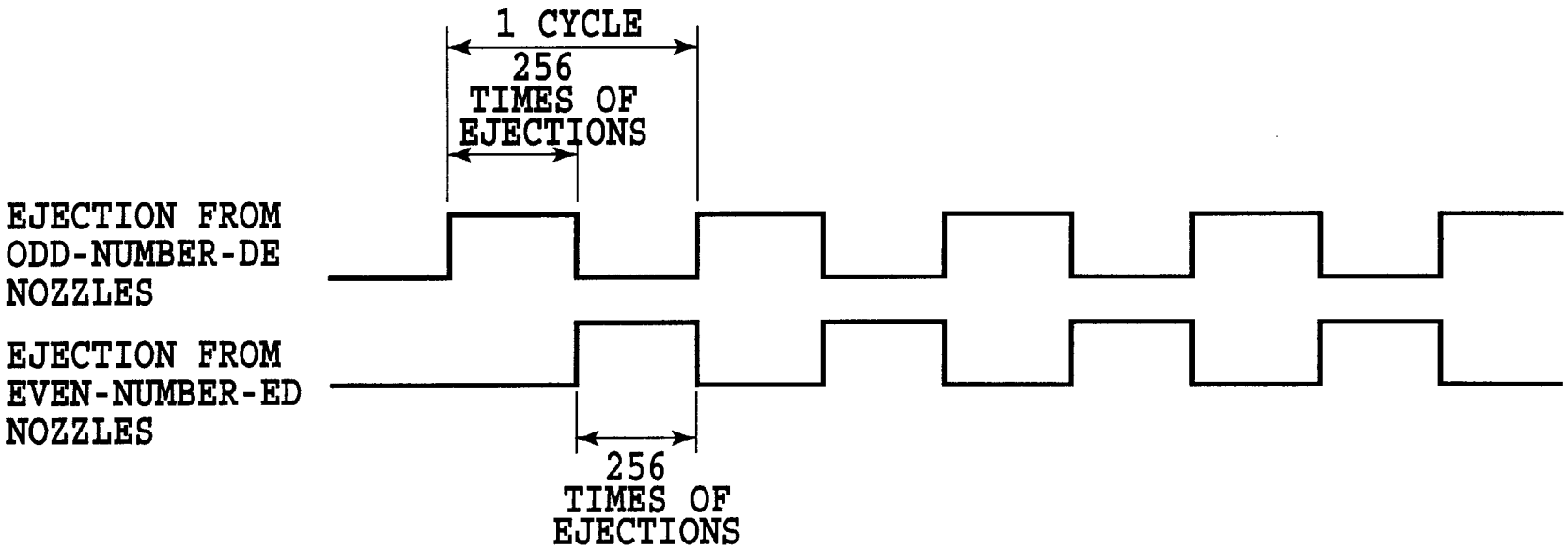
FIG. 12 is a time chart showing an example of a recovery operation in a preliminary ejection mode.

FIG. 12 is a time chart useful in explaining the preliminary ejection mode. In the preliminary ejection shown in FIG. 12, one cycle comprises 256 times of ejection from the odd-numbered nozzles and subsequent 256 times of ejection from the even-numbered nozzles and this cycle is repeated 20 times. The amount of ink consumed in this preliminary ejection mode is $15\times256\times256\times20\times10^{-9}$–0.02 cc when a specific gravity of ink is 1.

On the other hand, the operation in the suction mode in step S6 is similar to the suction operation performed when the empty tank is replaced with a new one. The amount of ink to be sucked is set depending on the configuration of the print head. It is set at about 0.15 cc for the print head used in this example. As a result, the amount of ink consumed in the suction mode is about 7.5 times as large as that in the preliminary ejection mode.

To assure the effectiveness of the above-mentioned recovery processing method, the channel miss detection and recovery process according to this example has been executed after the channel miss has been checked. Then, all the nozzles have ejected the ink successfully to enable normal printing.

Figure 13:
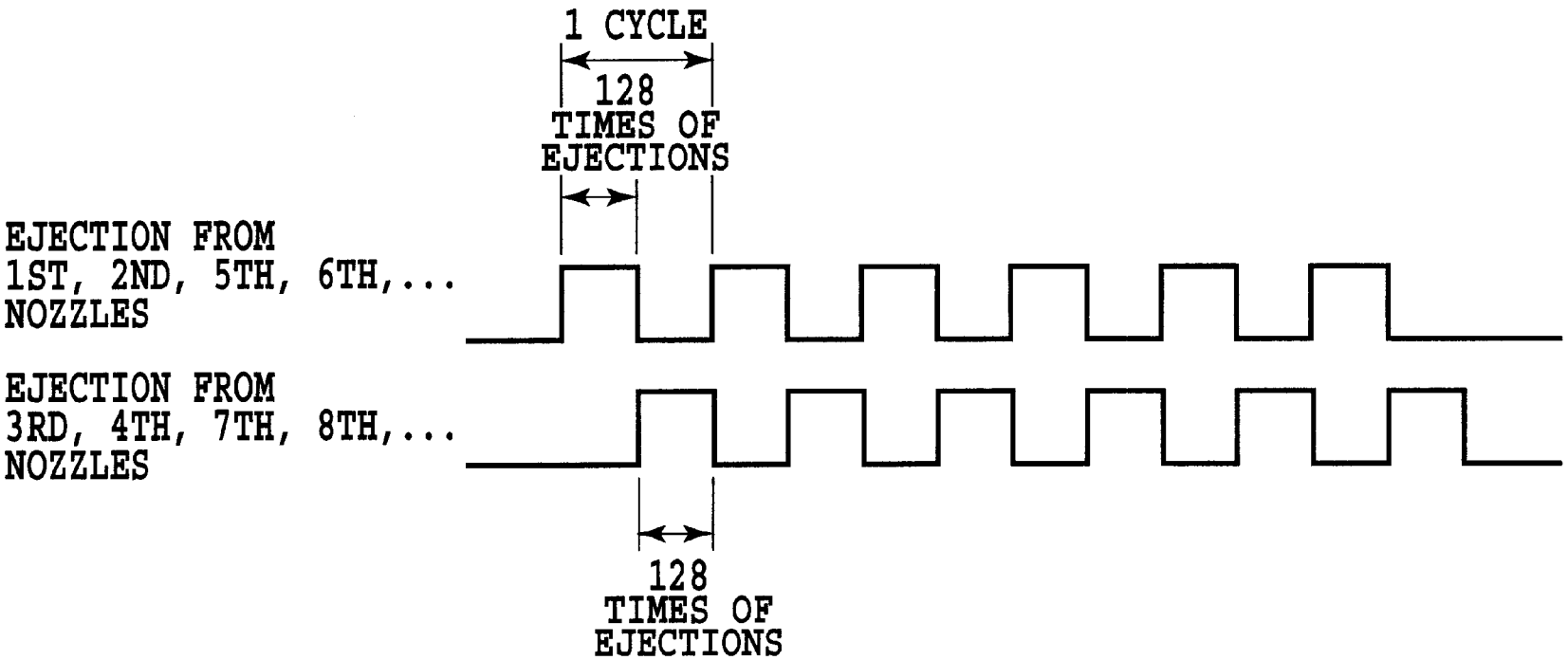
FIG. 13 is a time chart showing another example of the recovery operation in the preliminary ejection mode.

The preliminary ejection mode is not limited to the one shown in FIG. 12, but the combination of nozzles for simultaneous ejection, the number of times of ejection, the frequency of the ejection cycle, and the like may be arbitrarily varied, for example, as shown in FIG. 13.

In addition, in the step S4 in FIG. 11, it: is determined whether the number of channel miss nozzles is 5 or less, or more than 5, but the threshold n for determining the number of channel miss nozzles is not limited to this.

Furthermore, the recovery is more effectively improved by determining the conditions of channel miss nozzles in more detail. For example, even if five nozzles are in the channel miss, the recovery process may be varied between the case where the channel miss nozzles are continuous like the nozzles N1 to N5 in FIG. 10 and the case where the channel miss nozzles are discontinuous. That is, if the channel miss nozzles are continuous, then in the preliminary ejection mode, turbulence is relatively unlikely to occur in the ink in the nozzles. Accordingly, even if the number of channel miss nozzles is less than 5, the suction mode is executed if three continuous nozzles are in the channel miss, whereas the preliminary ejection mode is executed if the number of continuous channel miss nozzles is two or less.

Further, in this example, the channel miss detection is carried out after the receipt of the print command, but the present invention is not limited to this. It may be carried out, for example, after the print operation has been completed, after a predetermined number of sheets have been printed, or after a predetermined number of dots have been printed.

(Example 2 of the Recovery Process)

Figure 14:
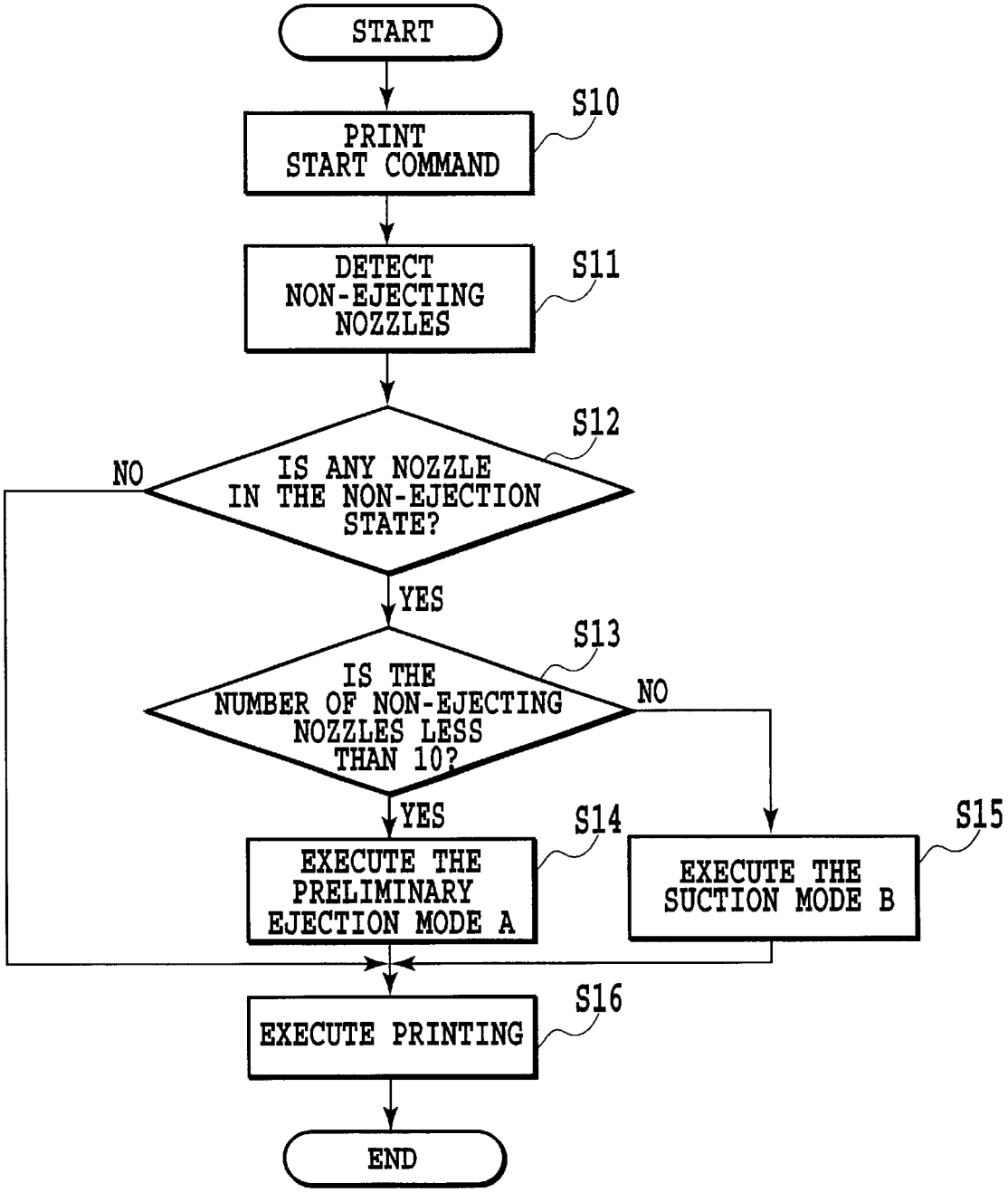
FIG. 14 is a flow chart showing a second embodiment for the recovery process executed by the ink jet printing apparatus according to the present invention.

FIG. 14 is a flow chart showing a second example of the recovery process for the ink jet printing apparatus. The operation of this process will be described with reference to FIG. 14.

In this second example, as shown in step S13, the threshold n for determining the number of channel miss nozzles is set at 10. So, a suction mode A is executed when the number of channel miss nozzles is 10 or less (step S14), whereas a suction mode B is executed when the number of channel miss nozzles is more than 10 (step S15). The suction normally achieves a higher level of recovery than the preliminary ejection, so that the threshold n for determining the number of channel miss nozzles is increased compared to the example shown in FIG. 11.

The suction mode A is set to a smaller amount of ink sucked than the suction mode B. This amount is required to cover the volume of the neighborhood of the nozzle portion. The required amount of ink sucked is set depending on the configuration of the print head, and in this example, it is set, for example, at about 0.05 cc for the suction mode A and at about 0.15 cc for the suction mode B.

The recovery processing method in this example has been confirmed to be effective on the recovery of the channel miss nozzles as in the first example.

(Example 3 of the Recovery Process)

Figure 15:
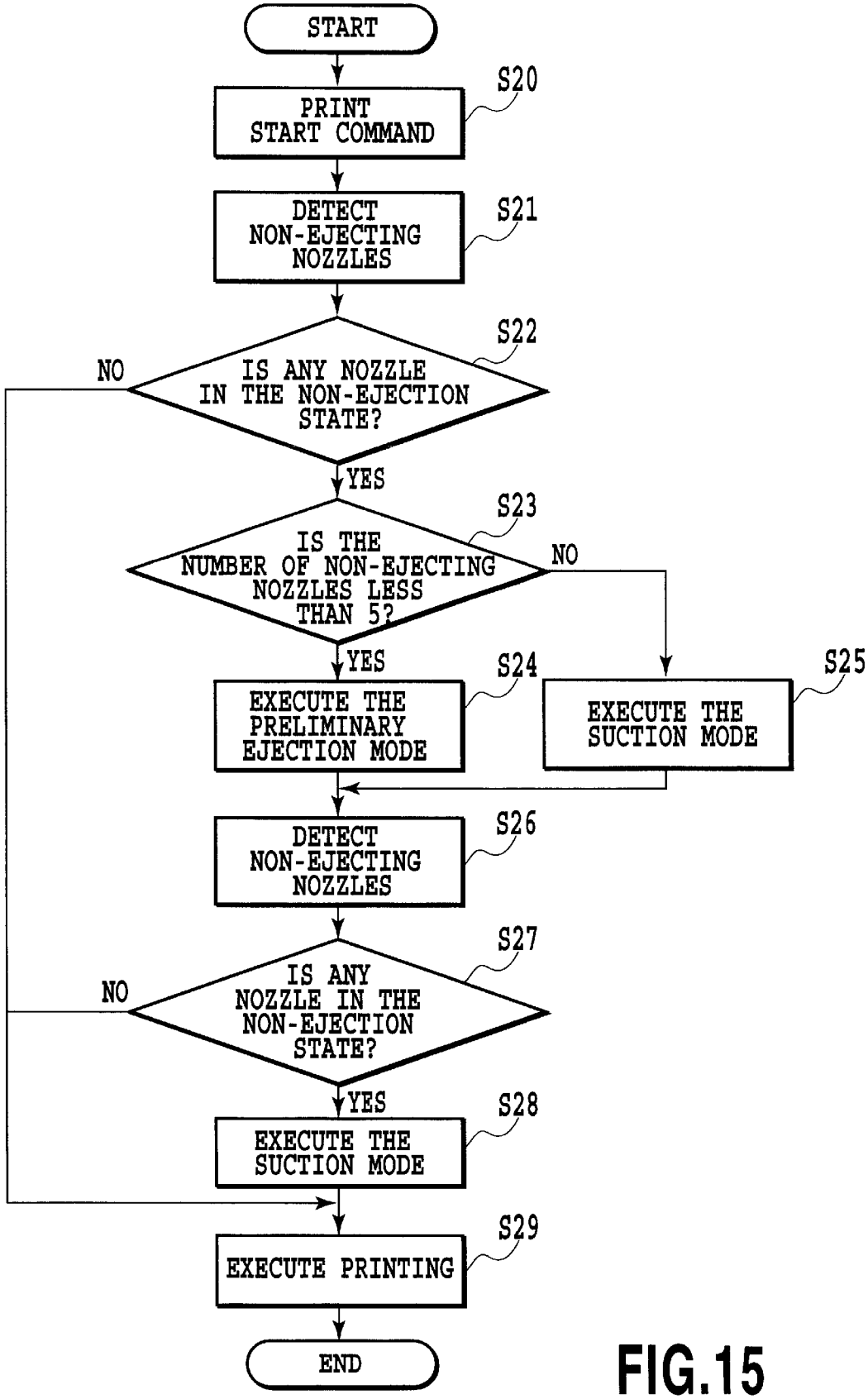
FIG. 15 is a flow chart showing a third embodiment for the recovery process executed by the ink jet printing apparatus according to the present invention.

FIG. 15 is a flow chart showing a third example of the recovery process for the ink jet printing apparatus. The operation of this process will be described with reference to FIG. 15.

This third example comprises the recovery process in the first example shown in FIG. 11 and the subsequent checking operation of detecting channel miss nozzles again.

That is, in FIG. 15, steps S20 to S25 correspond to steps S1 to S6 in FIG. 11.

After the recovery process in the preliminary ejection mode in step S24 or the recovery process in the suction mode in step S25 has been executed, channel miss nozzles are detected again in step S26.

If it is determined in step S26 that no nozzle is in the channel miss, the procedure proceeds to step S29 to execute printing. If, however, any nozzle is in the channel miss, then the procedure proceeds to step S28 to perform the same suction operation as that in step S25 before printing in step S29.

In this manner, the recovery processing method according to the third example carries out the detection of channel miss nozzles twice to improve the recovery.

The channel miss state is normally eliminated by executing the suction mode. Accordingly, in the flow chart in FIG. 15, the procedure may be changed so that the detection of channel miss nozzles in step S27 is carried out only if the preliminary ejection mode in step S24 has been executed, and so that if the suction mode in step S25 has been executed, the print operation is immediately performed instead of proceeding to step S26.

Further, in the above-mentioned example, the example of controlling the recovery operation based on the number of channel miss nozzles has been described, but the present invention is not limited to the above-mentioned number because the number of nozzles in the print head varies depending on the configuration of the apparatus or the print head. That is, if the number of nozzles in the print head differs from that described in the above examples, this number determines the number of channel miss nozzles as a determination criterion. In the present invention, the determination criterion for controlling the recovery operation is not limited to the number of channel miss nozzles but may be the ratio of the number of channel miss nozzles to the total number of nozzles.

Further, the configuration for detecting whether or not each nozzle is in the channel miss is not limited to the one described above, but various well-known techniques may be employed. Known configurations for detecting whether or not inappropriate ejection is occurring in each nozzle include, for example, the approach of printing a test pattern on a printing medium such as paper so that based on the results of visual checks on the printed pattern, the user can input information on inappropriately ejecting nozzles and the approach of using an optical sensor to read a printed pattern to detect inappropriately ejecting nozzles. In the present invention, such an approach may be employed as appropriate.

However, in the approach of checking the test pattern based on the user's visual check, the user may make mistakes in checking it or in inputting the information on the channel miss nozzles. Further, with the configuration for using the sensor to detect the printed pattern, the sensor must be accurate enough to read the pattern so as to correspond to each nozzle and it is difficult to accurately associate a location where the channel miss state is occurring with the corresponding nozzle.

The present invention can employ the principle of detection described with reference to FIGS. 1 to 6 to detect whether or not the channel miss state is occurring in each of the plural nozzles in the print head, thereby making it possible to accurately detect whether or not the channel miss state is occurring in each nozzle. Further, based on the results of this detection, the recovery process can be controlled so as to be efficiently executed, and the amount of ink consumed can be effectively reduced.

In the above-mentioned embodiments, the bubble jet printing method of ejecting ink using heating elements as printing elements has been explained by way of example. Other printing methods, however, can be used to detect, via the ink, variations in potential occurring if the printing elements are driven. The present invention is therefore applicable not only to the bubble jet printing method but also to other printing methods using, for example, piezoelectric elements.

(Others)

Incidentally, the present invention achieves distinct effect when applied to a print head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type inkjet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the print head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a print head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the print head, the present invention can achieve printing positively and effectively.

The present invention can be also applied to a so-called full-line type print head whose length equals the maximum length across a printing medium. Such a print head may consists of a plurality of print heads combined together, or one integrally arranged print head.

In addition, the present invention can be applied to various serial type print heads: a print head fixed to the main assembly of a printing apparatus; a conveniently replaceable chip type print head which, when loaded on the main assembly of a printing apparatus, is electrically connected to the main assembly, and is supplied with ink therefrom; and a cartridge type print head integrally including an ink reservoir.

It is further preferable to add a recovery system, or a preliminary auxiliary system for a print head as a constituent of the printing apparatus because they serve to make the effect of the present invention more reliable. Examples of the recovery system are a capping means and a cleaning means for the print head, and a pressure or suction means for the print head. Examples of the preliminary auxiliary system are a preliminary heating means utilizing electrothermal transducers or a combination of other heater elements and the electrothermal transducers, and means for carrying out preliminary ejection of ink independently of the ejection for printing. These systems are effective for reliable printing.

The number and type of print heads to be mounted on a printing apparatus can be also changed. For example, only one print head corresponding to a single color ink, or a plurality of print heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the inkjet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent: Application Laid-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

By employing the present invention, upon covering the ejection opening face with the cap at the predetermined position, the projecting portion is contacted with the predetermined row of the ejection openings, such as the ejection openings having low flow resistance to seal the predetermined row of the ejection openings. By performing suction in this condition, ink is sucked from the row of the ejection openings other than the predetermined row of ejection openings. Then, after sufficiently sucking the ink from the row of ejection openings other than the predetermined row of ejection openings, the cap is moved to release sealing by the projecting portion to effect sucking. Then, ink is sucked from the predetermined row of ejection openings. Thus, ink can be sucked from all of the ejection openings in just proportion. Therefore, satisfactory recovery process can be performed for all of the ejection openings having different flow resistance and can provide compact ink-jet printing apparatus and ejection recovery method.

Also, by further providing the modified lip portion to the lip portion of the cap, seal by the projecting portion can be released only by weakening the contact force to be exerted on the cap without the cap in parallel to the ejection opening surface after the first recover stage is completed, so that it becomes applicable for the apparatus having no space to move the cap. Also, the cap drive mechanism can be simplified.

Also, by providing the mechanism for driving only projecting portion, once the cap abuts on the ejection opening, the first recovery stage and the second recovery stage can be performed without moving the cap for achieving space saving.

As has been explained above, the present invention is structured to the recovery process with most suitable mode according to the channel miss state of a plurality of nozzles, so that the minimum necessary consumption of ink can eliminate this channel miss state of the plurality of nozzles. As a result thereof, increase of running cost, enlargement of apparatus size, and increase of manufacturing cost of the apparatus can be cut down.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A recovery processing method of an inkjet printing apparatus for forming images using a print head having a plurality of nozzles for ejecting ink droplets, comprising:

a first step for detecting each of the plurality of nozzles of the print head if there occurs channel miss states to any of the nozzles; and a second step for executing recovery processes based on a detection result of the first step, the second step executing different recovery processes depending on the channel miss states determined by channel miss degrees of nozzles in which channel misses are occurring among the plurality of nozzles.

2. The recovery processing method of an ink jet printing apparatus as claimed in claim 1, wherein in said first step, the number of nozzles in the channel miss state among said plurality of nozzles is determined, and in said second step, one of the different recovery processes is executed depending on a result of this determination.

3. The recovery processing method of an ink jet printing apparatus as claimed in claim 1, wherein in said second step, the recovery process corresponding to the states detected in said first step is selected from at least two of those recovery processes in a variety of preliminary ejection modes and those recovery processes in a variety of suction modes.

4. The recovery processing method of an ink jet printing apparatus as claimed in claim 3, wherein in said second step, the recovery process by the preliminary ejection mode is executed when the number of channel miss nozzles is determined to be less than a predetermined value, and the recovery process by the suction mode is executed when the number of channel miss nozzles is determined to be more than the predetermined value.

5. The recovery processing method of an ink jet printing apparatus as claimed in claim 1, wherein said ink jet printing apparatus comprises a plurality of printing elements for supplying thermal energy to a print head, a plurality of drive elements for driving said printing elements, and a detection electrode for detecting variations of voltage between each of said printing elements and each of corresponding drive elements occurring depending on the presence or absence of ink in the nozzle when said printing elements are driven, and wherein in said first step, whether or not said plurality of nozzles are in the channel miss state is detected based on a detection output from said detection electrode.

6. The recovery processing method of an ink jet printing apparatus as claimed in claim 1, wherein said first step and said second step are repeated several times.

7. A recovery processing unit of an ink jet printing apparatus for forming images using a printing head having a plurality of nozzles for ejecting an ink liquid, comprising:

channel miss detecting means for detecting each of the plurality of nozzles of the printing head if there occurs channel miss states to any of the nozzles; and recovery control means for executing recovery processes based on a detection result of the channel miss detecting means, the recovery control means executing different recovery processes depending on the channel miss states determined by channel miss degrees of nozzles in which channel misses are occurring among the plurality of nozzles.

8. The recovery processing unit of an inkjet printing apparatus as claimed in claim 7, said channel miss detecting means determines the number of nozzles in the channel miss state among said plurality of nozzles, to detect the channel miss states of the nozzles based on a result of this determination.

9. The recovery processing unit of an inkjet printing apparatus as claimed in claim 8, wherein said recovery control means selects the recovery process corresponding to the states detected by said channel miss detecting means, from at least two of those recovery processes in a variety of preliminary ejection modes and those recovery processes in a variety of suction modes.

10. The recovery processing unit of an ink jet printing apparatus as claimed in claim 9, wherein said recovery control means executes the recovery process in the preliminary ejection mode when the number of channel miss nozzles is determined to be less than a predetermined value, while said recovery control means executes the recovery process in the suction mode when the number of channel miss nozzles is determined to be more than the predetermined value.

11. The recovery processing unit of an inkjet printing apparatus as claimed in claim 7, wherein said ink jet printing apparatus comprises a plurality of printing elements for supplying thermal energy to a print head substrate of said print head, and a plurality of driving elements for driving said printing elements, and wherein said channel miss detecting means comprises a detection electrode for detecting variations of voltage between each of said printing elements and each of corresponding drive elements occurring depending on the presence or absence of ink in the nozzle when said printing elements are driven in order to detect the channel miss states of said plurality of nozzles based on a detection output from said detection electrode.

* * * * *

UNITED STATES PATENT AND TRADEMARK OFFICE

CERTIFICATE OF CORRECTION

PATENT NO. : 6,719,400 B2
DATED : April 13, 2004
INVENTOR(S) : Inui et al.

It is certified that error appears in the above-identified patent and that said Letters Patent is hereby corrected as shown below:

Title page,
Item [56], References Cited, OTHER PUBLICATIONS, "63,382,765." should read -- 6,382,765. --.
Item [57], ABSTRACT,
Line 2, "state" should read -- states --.

Drawings,
Sheet 5, Figure 5, "ETECTION" should read -- DETECTION --.

Column 5,
Line 22, "FIG. 3 is" should read -- FIG. 3 is a --.

Column 6,
Line 67, "amplitudeis." should read -- amplitude is. --.

Column 9,
Line 6, "driving" should read -- driving of --.

Column 11,
Line 5, "-0.02 cc" should read -- =0.02 cc --.

Column 14,
Lines 13 and 39, "be also" should read -- also be --.
Line 16, "consists" should read -- consist --.

Signed and Sealed this

Twenty-first Day of December, 2004

JON W. DUDAS
*Director of the United States Patent and Trademark Office*